US005082512A

United States Patent [19]

Futamura et al.

[11] Patent Number: 5,082,512

[45] Date of Patent: Jan. 21, 1992

[54] BORONIZED SLIDING MATERIAL

[75] Inventors: Kenichiro Futamura; Sumyong Hong; Sinichi Mizuguchi, all of Toyota, Japan

[73] Assignee: Taiho Kogyo Co., Ltd., Toyota, Japan

[21] Appl. No.: 369,974

[22] Filed: Jun. 22, 1989

[30] Foreign Application Priority Data

Jul. 22, 1988 [JP] Japan ..... 63-181671

[51] Int. Cl.[5] ..... C23C 8/70

[52] U.S. Cl. ..... 148/330; 148/14; 148/279; 428/627; 428/681; 252/12

[58] Field of Search ..... 428/472.1, 472.2, 472.3, 428/627, 681, 497; 164/479; 148/302, 330, 304, 14, 306, 279; 106/36; 252/12

[56] References Cited

U.S. PATENT DOCUMENTS 4,134,779 1/1979 Ray ..... 148/306
4,285,640 8/1981 Mukai ..... 417/269
4,483,724 11/1984 Hasegawa ..... 148/306
4,532,979 8/1985 Hasegawa ..... 164/479
4,683,804 8/1987 Futamura et al. ..... 417/209
4,792,368 12/1988 Sagawa ..... 148/302
4,834,814 5/1989 Hasegawa ..... 148/304

FOREIGN PATENT DOCUMENTS 61-167180 7/1986 Japan .
61-201782 9/1986 Japan .
63-159685 7/1988 Japan .

*Primary Examiner*—Jay H. Woo
*Assistant Examiner*—J. F. Durkin, II
*Attorney, Agent, or Firm*—Armstrong, Nikaido, Marmelstein, Kubovcik & Murray

[57] ABSTRACT

Seizure resistance of boronized sliding material is improved by surface microstructure, i.e., co-existence of the $Fe_2B$ phase and $Fe_3B$ phase.

5 Claims, 7 Drawing Sheets

BORONIZED SLIDING MATERIAL

BACKGROUND OF INVENTION

1. Field of the Invention

The present invention relates to boronized sliding material.

More particularly, the present invention relates to boronized sliding material which is highly resistant to seizure by the opposite material when sliding.

2. Description of Related Arts

Boronizing is broadly employed for surface treatment for enhancing the wear resistance of mainly ferrous materials.

Borides having an ultra-high hardness are formed on the surface of boronized ferrous materials and make them more wear-resistant. The presence of FeB and $Fe_2B$ are shown in the Fe-B equilibrium phase diagram. It is these borides that are formed in the surface layer of boronized materials. Hardness of FeB ranges from Hv 1800 to 2000, and hardness of $Fe_2B$ ranges from Hv 1400 to 1800. The phase diagram shows that the structure of boronized ferrous material is a single FeB phase, dual mixed phase of FeB and $Fe_2B$, or a single $Fe_2B$ phase. In most of the boronized materials, however, the structure is the dual mixed FeB and $Fe_2B$ phases. This is because: FeB, which is brittle, is not appropriate, as a single surface phase, for the sliding surface, and, the quantity of boron-impregnation for obtaining the single FeB phase is difficult; and, further the single FeB phase does not exhibit a high seizure resistance, particularly under conditions where the oil supply is liable to be interrupted.

The cross section of the sliding surface composed of dual mixed FeB and $Fe_2B$ phases exhibits minute uneveness which is formed by protruding FeB and recessing $Fe_2b$ due to the difference of hardness between FeB and $Fe_2B$. Since FeB is hard and brittle. The protrusions occasionally break during sliding and the broken fragments damage the opposite member, and cause sudden wear. When the opposite member wears drastically and the lubrication is severe, as described above, the opposite member softens and then the fusion bonding is liable to occur. The seizure resistance of the conventionally boronized, ferrous sliding materials is not said to be satisfactory, as is described above.

It has long been considered that the phases present in the Fe-B system are FeB, $Fe_2B$ and Fe. Formation of $Fe_3B$ phase has, however, relatively recently been discovered in the formation of iron borides by CVD (chemical vapor deposition).

SUMMARY OF THE INVENTION

It is an object of the present invention to provide boronized ferrous sliding material which has improved seizure resistance.

During the study of the boronizing methods, the present inventors discovered that, when the solid method was employed for boronizing, the above mentioned $Fe_3B$ phase was formed in the boronized materials at an intermediate boron concentration region between the concentrations of $Fe_2B$ and Fe phases. In such boronized and $Fe_3B$-formed material, the $Fe_2B$ phase is in the form of a layer, and $Fe_3B$ phase formed extends along the $Fe_2B$ layer. The present inventors further discovered that the seizure resistance is considerably improved over the conventionally boronized materials, by the copresence of $Fe_3B$ and $Fe_2B$ phases on the sliding surface of the boronized material.

Therefore, the present invention provides a boronized material having improved seizure resistance, whose sliding surface is boronized and comprises a $Fe_2B$ phase and a $Fe_3B$ phase.

The present invention is described in detail with reference to the drawings.

DESCRIPTION OF PREFERRED EMBODIMENTS

The surface structure of boronized carbon steel (S45C in the embodiment described hereinafter) is described with reference to FIGS. 1 through 7. The boronizing method was a solid method, boronizing temperature was 900° C., and boronizing time was 5 hours, in the present embodiment described hereinafter.

Figure 1:
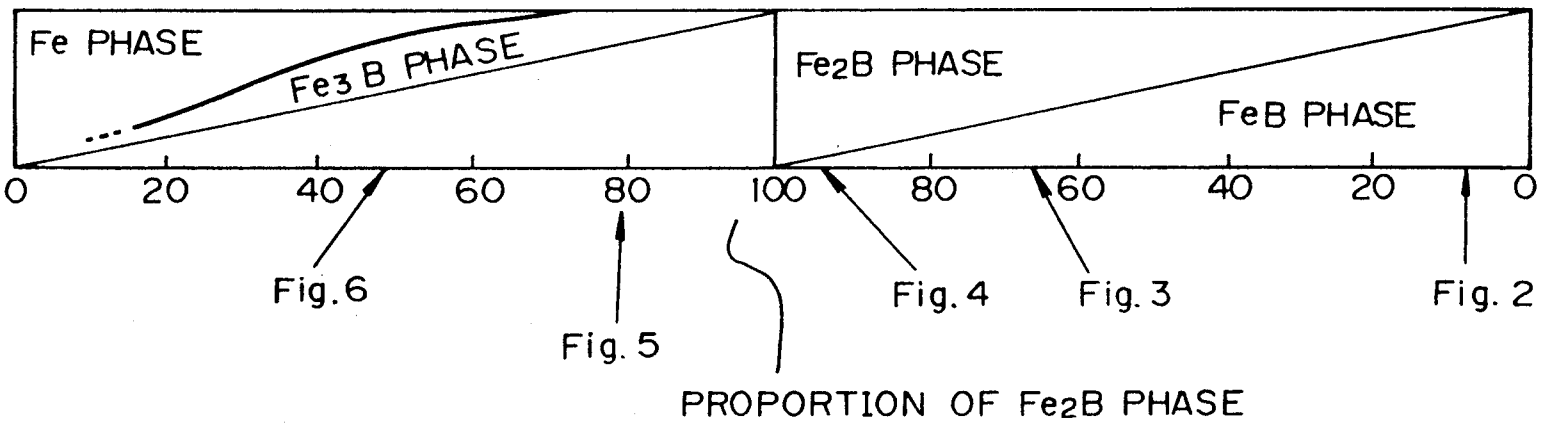
FIG. 1 is a drawing showing the proportion of constituent structures of the surface layer of a ferrous material which has been boronized.

The abscissa in FIG. 1 indicates the depth from the treated material. The right end corresponds to the outermost surface. The suffix numerals of abscissa indicate the proportion of the $Fe_2B$ phase. The zero % at the right side of the drawing indicates no presence of the $Fe_2B$ phase on the outermost surface; that is, the FeB phase is the only constituent phase. The zero % at the left side of the drawing indicates no presence of $Fe_2B$ phase in the interior; that is, the Fe phase is the only constituent phase.

The drawings in FIGS. 2–6 show the microstructure at the corresponding depth indicated by the leader lines from the abscissa. FIG. 7 shows the X-ray diffraction peaks and the proportion of respective surface phases of FIGS. 2 through 6.

Figure 2:
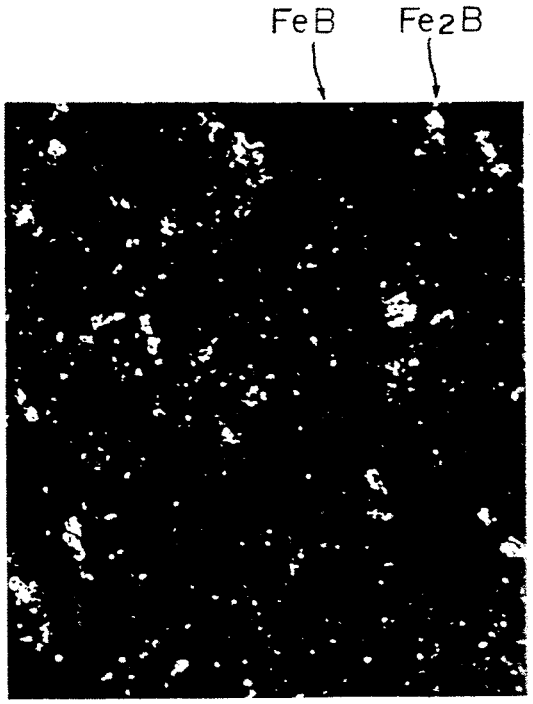
FIGS. 2 through 6 are electron microscopic photographs showing the micro structure of the surface layer at positions shown in FIG. 1.
Figure 3:
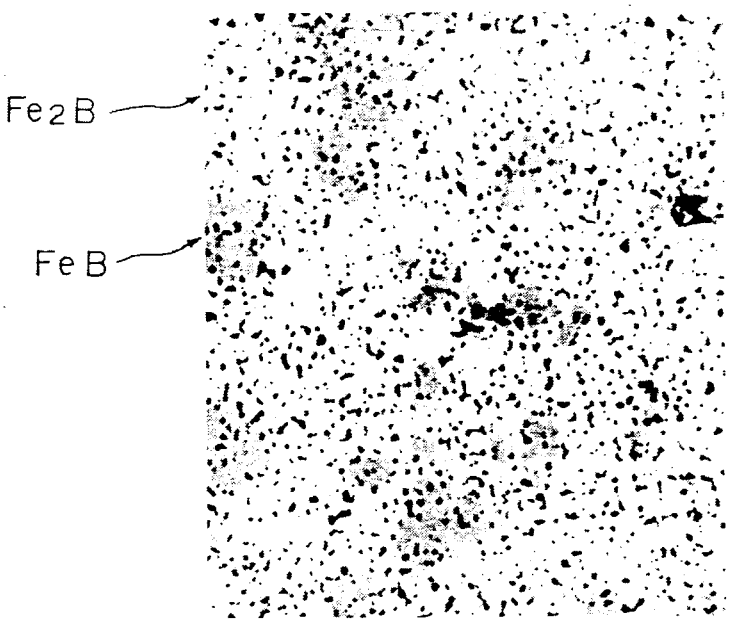
Figure 4:
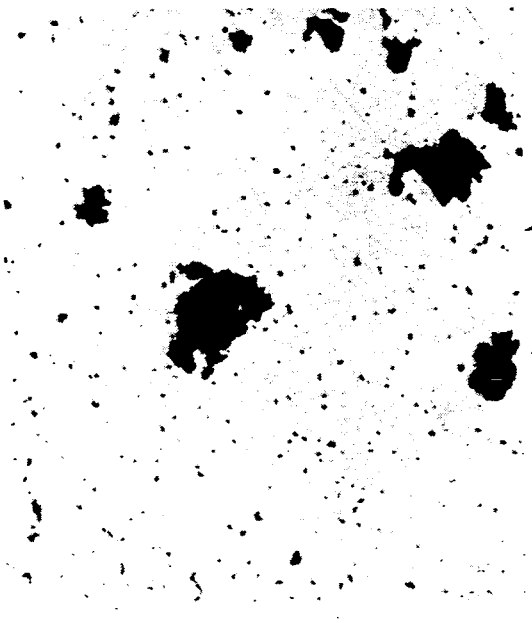

The structure in the direct vicinity of the outermost surface is a finely dispersed structure of FeB and $Fe_2B$ phases (FIG. 2). The structure at an inner part is shown in FIGS. 3 and 4. Namely, the proportion of the FeB phase becomes smaller, and the proportion of the $Fe_2B$ phase becomes greater. In addition, FeB is dispersed in the form of nodules. These nodules are isolated from one another and are surrounded by the $Fe_2B$ phases. A single FeB phase is formed at a certain depth from the surface. The existing region of the single FeB phase is, however, limited to an extremely narrow width as contrary to the presence of the mixed phases.

Figure 5:
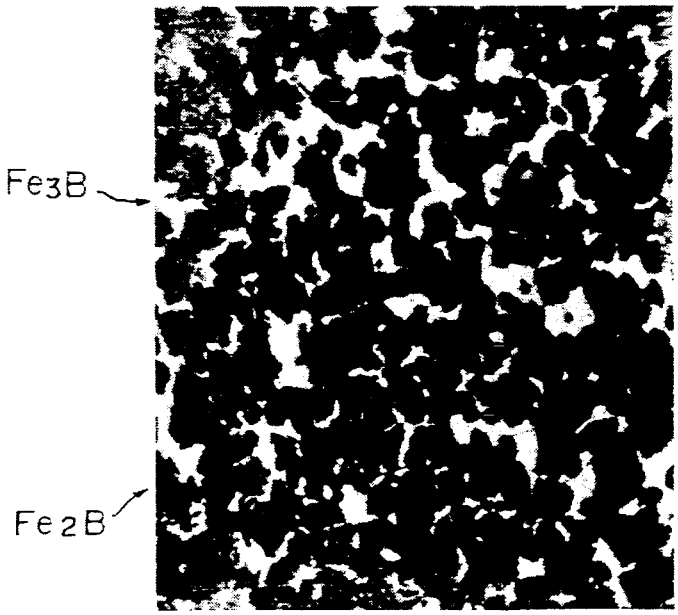
Figure 6:
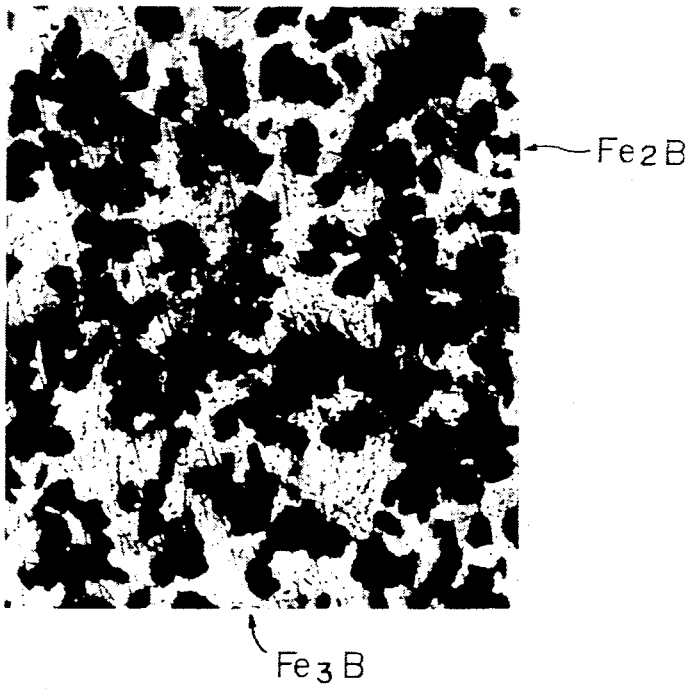
Figure 7:
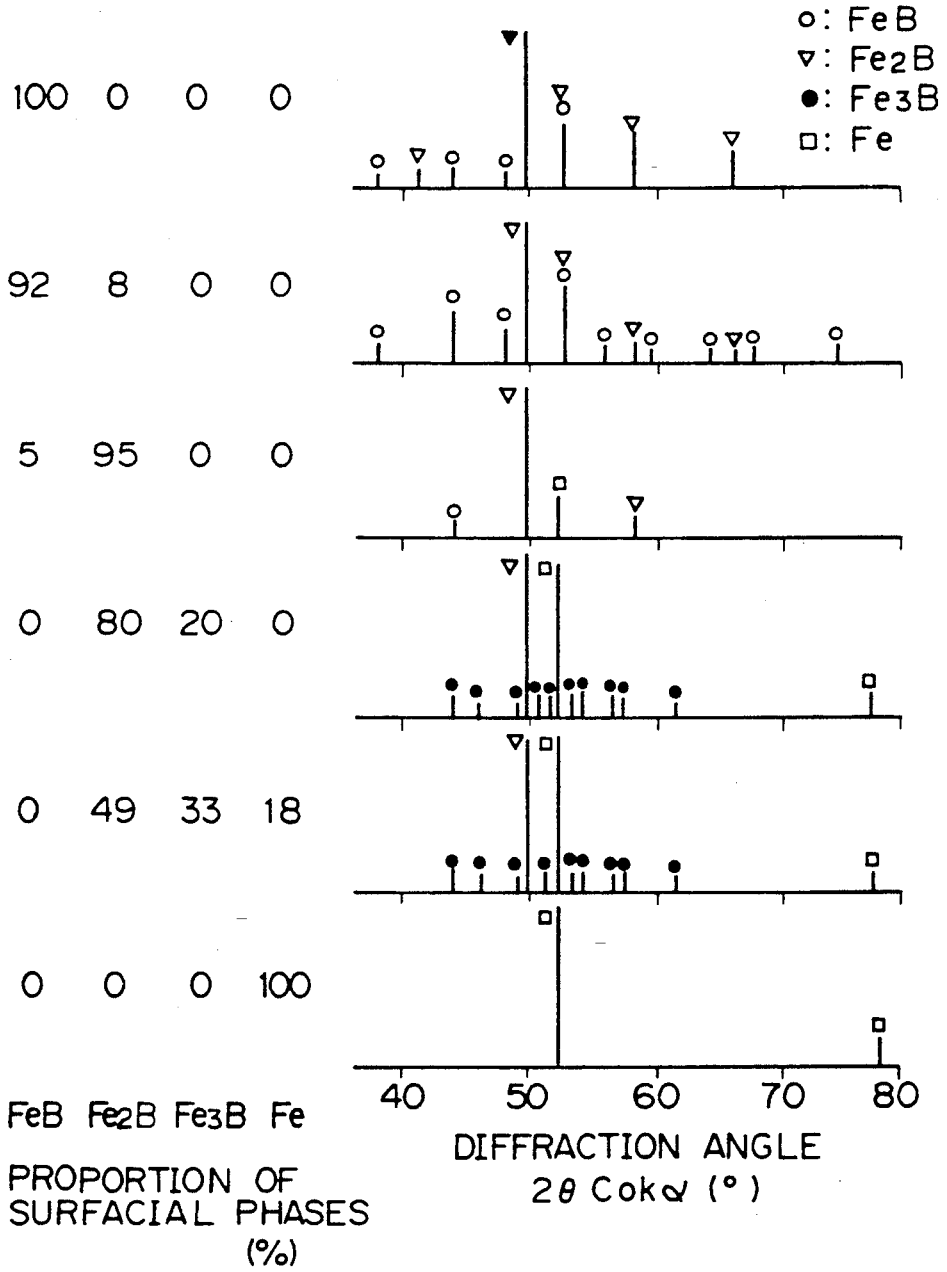
FIG. 7 is a chart showing the X-ray diffraction peaks and the proportion of the respective phases at positions shown in FIG. 1.

The $Fe_3B$ phase, which is characteristic of the present invention, is formed at a deeper position (FIGS. 5 and 6). The mixed $Fe_3B$ and $Fe_2B$ phases shown in FIGS. 5 and 6 exhibit a coarsely dispersed structure as compared with the finely dispersed structure as shown in FIG. 2. The reason for such coarse dispersion resides in that: the $Fe_3B$ and $Fe_2B$ phases in layer form are in contact with one another as seen in the cross section;

these layers are not perfectly parallel to the surface of a workpiece but exhibit some undulation; and, when the workpiece is polished parallel to its surface, the lower layer ($Fe_3B$ phase) appears at positions where the upper layer ($Fe_2B$ phase) is polished off. Incidentally, when the proportion of the $Fe_2B$ phase is less than 75%, the three phases, Fe, $Fe_3B$ and $Fe_2B$, are mixed. The binary Fe-B series equilibrium phase diagram shows that the three phases are not co-present or mixed. However, the inventive boronized material exhibits a layer-structure as is described above and hence does not exhibit an equilibrium structure. The mixed triple phases structure is therefore formed in the inventive boronized material.

When the proportion of the $Fe_2B$ phase is from approximately 75% to less than 100%, a mixed dual phase of $Fe_3B$ and $Fe_2B$ is formed. When the proportion of the $Fe_2B$ phase is from approximately 75% to 0%, the mixed triple phase of $Fe_3B$, $Fe_2B$ and Fe is formed. These coexisting structures of $Fe_3B$ and $Fe_2B$ exhibit improved seizure resistance. Seizure resistance is considerably improved when the proportions of the $Fe_2B$ and $Fe_3B$ phases are 96–45% and 35–4% respectively, since these phases are balanced well on the sliding surface. The structure of the sliding surface may be composed of only these two phases or be composed of these phases and an additional Fe phase. Good seizure resistance can be obtained even if the Fe phase is present, provided that the $Fe_3B$ and $Fe_2B$ phases are well balanced as described above.

Preferred range of $Fe_2B$ and $Fe_3B$ is from 95 to 45% and from 35 to 5%, respectively. More preferred range of $Fe_2B$ and $Fe_3B$ is from 90 to 50% and from 32 to 5%, respectively. The most preferred range of $Fe_2B$ and $Fe_3B$ is from 90 to 65% and from 30 to 10%, respectively. Dispersion in the sliding characteristics can be lessened at the $Fe_3B$ proportion of 10% or more. When the proportion of the Fe phase exceeds 20%, the seizure resistance is impaired. The proportion of the Fe phase is therefore preferably 20% or less. Preferred proportion of Fe phase is 18% or less, and, more preferred proportion of Fe phase is 5% or less.

Desirably, the FeB phase is not present or, if present, is less than 5% by area or less on the sliding surface.

FeB can coexist with $Fe_2B$ and $Fe_3B$ because of any one of the following reasons: the surface of a substrate is not perfectly flat but has minute undulation or an appreciable roughness; the thickness of boride layer varies locally; and, FeB remains slightly on the sliding surface of the boronized and then polished substrate.

The proportion of FeB is preferably 1% or less. FeB should however be absent.

The proportion of the respective phases in FIGS. 1 through 6 was measured by obtaining the area % of respective phases by a metallographic microscope.

The opposing materials of the inventive boronized sliding material are usually aluminum alloys, in particular, a high-Si aluminum alloy, and steel.

The inventive boronized material and the above opposing materials provide outstandingly high seizure resistance.

The above described boronized surface, which contains the $Fe_3B$ phase, is formed by carrying out, at a temperature of from 800° to 1000° C., the solid boronizing method with the use of boronizing agents comprising $B_4C$, SiC, C, and potassium borofluoride, and, subsequently, removing, by polishing or the like, the outermost surface where the FeB phase is formed. When a workpiece is made of low carbon steel or medium carbon-steel, the $Fe_3B$ and $Fe_2B$ phases are formed in undulating layers. In this case, the surface structure, where both phases are co-existing, is obtained by means of polishing the boron-impregnated surface parallely so as to remove approximately 1/5—approximately $\frac{3}{4}$ times the thickness of the boron-impregnated layer.

The low-carbon steels are, however, not preferred as the sliding material, since their strength is unsatisfactory, and, hence the non-boronized body of the sliding member does not exhibit desirable properties. In the case of high carbon-steels, there is a tendency for the $Fe_3B$ and $Fe_2B$ phases to form in parallel layers. In order to obtain a sliding surface where both phases appear, minute unevenness is formed on the sliding surface by means of abrasive particles. Such minute unevenness contributes to enhancement of the seizure resistance.

Ferrous material of substrate can be selected from low-carbon steels, medium-carbon steels, high-carbon steels, and low-alloyed steels. Low carbon-steels stipulated in JIS Standard, such as S10C and S15C, are inexpensive and advantageous in the point that the boride layer is easily formed. On the other hand, in the case of using high-carbon steels, such as SK5 containing 0.8% of C, a hard substrate is provided and attains such advantage that the deformation of sliding material is lessened when subjected to high load. Medium carbon steels, such as S45C and S55C, exhibit balanced properties, i.e., easy formation of boride layer and small deformation of a substrate, and, hence, are used as a substrate without incurring any difficulty. Case hardening-steels, such as chromium steel having C content of from 0.15 to 0.5% can be used as the alloyed steels.

The physical properties of the $Fe_3B$ phase are now described.

It is known that the crystal system of the $Fe_3B$ phase is tetragonal and rhombic. According to measurement by the present inventors the hardness of the $Fe_3B$ phase is Hv 800 to 1000. Since the hardness of $Fe_3B$ is less than that of $Fe_2B$, the wear resistance of $Fe_3B$ seem to be inferior to $Fe_2B$, but toughness of $Fe_3B$ is superior to $Fe_2B$. On the other hand, FeB is so brittle.

The sliding material, on the surface of which both phases having the above described properties co-exist, and FeB, which is brittle, is completely removed by polishing or the like or is as small as possible, exhibits improved seizure resistance.

The present invention is hereinafter described by way of the examples.

EXAMPLE 1

Medium carbon steel S45C was boronized for 5 hours at 900° C. The boronizing agent used was a powder mixture which consisted of 3–20 parts of $B_4C$, 50–85 parts of SiC, 10–30 parts of C, and 0.5–7 parts of potassium borofluoride. The workpieces to be boronized were embedded in the powder during boronizing. The boride layers were formed on the surface of the workpieces to a depth of 100 μm. The surface of the workpieces was removed, while changing the removal depth, and was then subjected to buffing (roughness Rz=0.1 μm) using diamond abrasives.

The seizure resistance test was then carried out while using S45C (no surface-hardened material) as the opposing material.

The test condition was as follows.

Tester: a pin-trust tester

Load: constant (10 kg/cm$^2$)

Circumferential speed: 5 m/sec

Lubricating oil: light oil (one drop)

Figure 8:
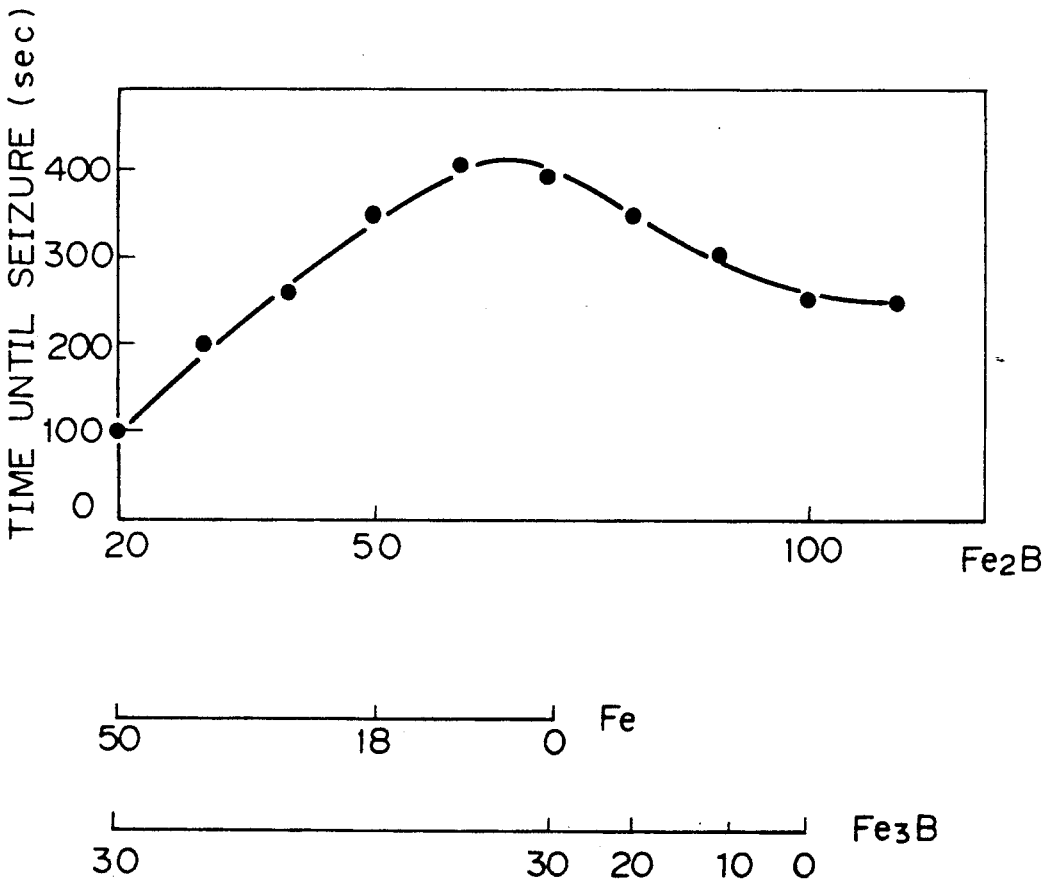
FIG. 8 is a graph showing the proportion of constituent phases of surface and time until seizure.

The test results are shown in FIG. 8.

As is shown in FIG. 8, the seizure resistance is high when the $Fe_2B$ phase and an appropriate amount of the $Fe_3B$ phase are balanced. In the tested specimens, the seizure resistance is at a maximum when the $Fe_2B$ phase is in an amount of from 65 to 90%, the Fe phase is in an amount of from 0 to 5%, and the $Fe_3B$ phase is in an amount of from 10 to 30%. The Fe phase itself does not enhance but rather impairs the seizure resistance. However, when an appropriate amount of the $Fe_3B$ and $Fe_2B$ phases are co-existing, high seizure resistance is obtained notwithstanding the fact that a considerable amount of the Fe phase exists at the sliding layer.

EXAMPLE 2

As-rolled (not quenched) S45C and quenched S45C in the form of a disc were used as the opposing materials. The material which was boronized as in Example 1 was subjected to the seizure test as in Example 1, except that the seizure was gradually increased.

Figure 9:
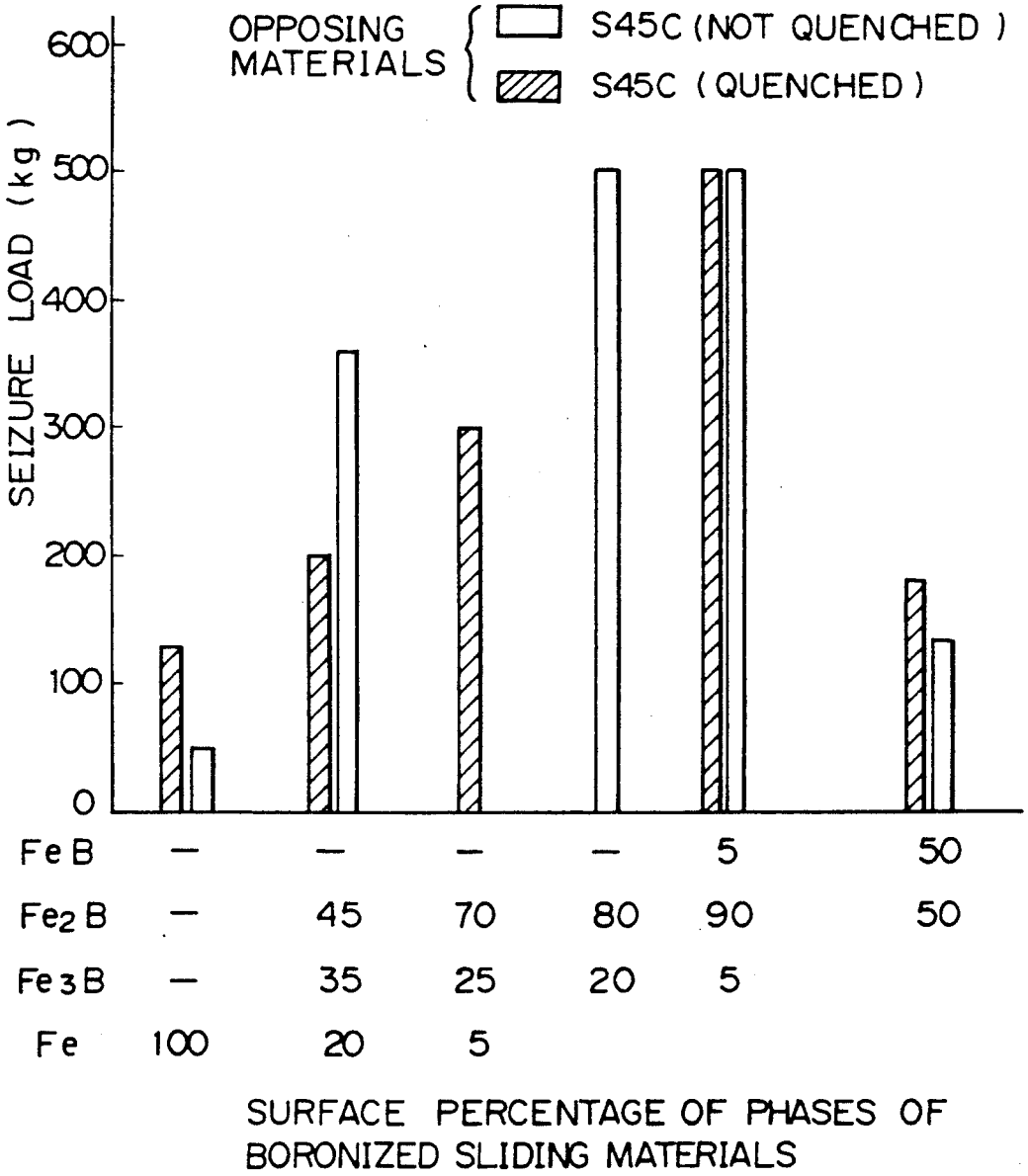
FIG. 9 is a graph showing relationships between the proportion of constituent phases of surface and seizure load.

The test results, as shown in FIG. 9, indicate that a high seizure resistance is obtained by the co-existance of at least $Fe_3B$ and $Fe_2B$ phases.

As is described hereinabove, the seizure-resistance obtained by the present invention is higher than that of conventionally boronized materials. The boronized material according to the present invention is therefore appropriate for conditions of a severe lubrication. Particularly, the boronized material according to the present invention is advantageously used as the bush and thrust washer which tends to be used under severe sliding conditions with little lubricating oil.

We claim:

1. A boronized sliding material having improved seizure-resistance and consisting of a boronized ferrous material, wherein the sliding surface of said material consists of from 96 to 65 area % of an $Fe_2B$ phase and from 35 to 4 area % of an $Fe_3B$ phase.

2. A boronized sliding material having improved seizure-resistance and consisting of a boronized ferrous material, wherein the sliding surface of said material consists of an $Fe_2B$ phase and an $Fe_3B$ phase, and 20 area % or less of an Fe phase.

3. A boronized sliding material according to claim 2, wherein the sliding surface consists of from 96 to 45 area % of the $Fe_2B$ phase and from 35 to 4 area % of the $Fe_3B$ phase.

4. A boronized sliding material having improved seizure-resistance and consisting of a boronized ferrous material, wherein the sliding surface of said material consists of an $Fe_2B$ phase and an $Fe_3B$ phase, and 5 area % or less of an FeB phase.

5. A boronized sliding material having improved seizure-resistance and consisting of a boronized ferrous material, wherein the sliding surface of said material consists of from 90 to 50 area % of an $Fe_2B$ phase, from 32 to 5 area % of an $Fe_3B$ phase, 20 area % or less of an Fe phase, and 5 area % or less of an FeB phase.

* * * * *